US008262385B2

(12) United States Patent
Marcotullio et al.

(10) Patent No.: US 8,262,385 B2
(45) Date of Patent: Sep. 11, 2012

(54) AQUEOUS DISPERSIONS OF HEAVY OIL RESIDUES

(75) Inventors: Armando Marcotullio, Milanese-Milan (IT); Riccardo Rausa, Milanese-Milan (IT); Alessandro Lezzi, Milan (IT)

(73) Assignee: Enitecnologie S.p.A., San Donato Milanese (IT)

( * ) Notice: Subject to any disclaimer, the term of this patent is extended or adjusted under 35 U.S.C. 154(b) by 2418 days.

(21) Appl. No.: 10/468,831

(22) PCT Filed: Feb. 22, 2002

(86) PCT No.: PCT/EP02/01964

§ 371 (c)(1), (2), (4) Date: Feb. 11, 2004

(87) PCT Pub. No.: WO02/070634

PCT Pub. Date: Sep. 12, 2002

(65) Prior Publication Data

US 2004/0134833 A1 Jul. 15, 2004

(30) Foreign Application Priority Data

Mar. 5, 2001 (IT) ..... MI2001A0445

(51) Int. Cl.
*C10L 1/12* (2006.01)
*C10L 1/32* (2006.01)

(52) U.S. Cl. ..... 431/2; 44/301

(58) Field of Classification Search ..... 44/280, 44/281, 622, 301; 208/14, 18, 179; 516/21; 431/2

See application file for complete search history.

(56) References Cited

U.S. PATENT DOCUMENTS

| | | | | | |
|---|---|---|---|---|---|
| 4,886,519 | A | * | 12/1989 | Hayes et al. | 44/301 |
| 4,983,187 | A | * | 1/1991 | Lagana et al. | 44/280 |
| 5,445,179 | A | * | 8/1995 | Di Lullo et al. | 137/13 |

FOREIGN PATENT DOCUMENTS

| | | |
|---|---|---|
| EP | 0 325 309 | 7/1989 |
| EP | 0 512 721 | 11/1992 |
| EP | 0 607 425 | 7/1994 |
| JP | 56 159291 | 12/1981 |
| JP | 07 003278 | 1/1995 |
| JP | 07 062364 | 3/1995 |

OTHER PUBLICATIONS

Booth, "Naphthalene Derivatives" in: Ullmann's Encyclopedia of Industrial Chemistry (1991 ed.), vol. A17, pp. 11, 15.*

E. Fitzer et al., Pure & Appl. Chem., "Recommended Terminology for the Description of Carbon as a Solid", 1995, vol. 67, No. 3, pp. 473-506.

* cited by examiner

*Primary Examiner* — Randy Boyer

(74) *Attorney, Agent, or Firm* — Oblon, Spivak, McClelland, Maier & Neustadt, L.L.P.

(57) ABSTRACT

A description follows of an aqueous dispersion of heavy oil residues, suitable for undergoing combustion with a low emission of $SO_x$, comprising: (a) a heavy oil residue; (b) a dispersing agent; (c) a desulfurizing agent selected from $CaCO_3$, $MgCO_3$, dolomite and relative mixtures; (d) a desulfurizing agent with stabilizing and anti-corrosive properties selected from MgO, $Mg(OH)_2$, CaO, $Ca(OH)_2$ and relative mixtures; (e) water; the weight percentage of (e) with respect of the sum of (a)+(e) being at least 15%.

5 Claims, No Drawings

AQUEOUS DISPERSIONS OF HEAVY OIL RESIDUES

The present invention relates to aqueous dispersions of heavy oil residues and their preparation.

More specifically, the present invention relates to the preparation of aqueous dispersions of heavy oil residues suitable for being transported, usually in pipelines, and for undergoing combustion with a reduced emission of harmful substances, particularly $SO_x$.

The term "heavy oil residues" refers to oil residues or oil fractions having an API degree lower than 15 and a viscosity at 30° C. higher than 40000 mPas. Typical examples of these oil residues are residues from the vacuum distillation of crude oils or other oil fractions (for example the distillation residue at atmospheric pressure) and vis-breaking residues. These oil fractions are sometimes solid at room temperature with a softening point higher than 80° C., in some cases higher than 100° C. These residues, however, do not flow and have a very high viscosity. For this reason, they cannot be used as fuels, unless they are heated to temperatures of at least 280° C. In any case there would be considerable drawbacks both in the moving and atomization phase, and they would also cause obstruction of the transport lines.

Patent literature describes various processes for moving heavy crude oils or viscous oil fractions, which cannot be compared, however, as far as the properties are concerned, to the above heavy oil residues.

One of the most widely studied methods for moving heavy crude oils consists in the formation of oil-in-water emulsions (O/W), in which the outer phase (water) is less viscous than the internal phase (oil). These emulsions, prepared by mixing water, an emulsifier and oil, under stirring, can be easily moved. In addition to having a low viscosity, these emulsions must have a certain stability, i.e. they must not separate into two phases during the transporting phase and possible storage. Furthermore the emulsifying additives should allow the formation of emulsions with a high content of oil phase. Regardless of these characteristics, a fundamental requisite for the use of this technique consists of the low cost of the emulsifying agents.

The emulsifying agents proposed in patent literature do not satisfy these requisites.

For example, U.S. Pat. No. 4,246,920, U.S. Pat. No. 4,285,356, U.S. Pat. No. 4,265,264 and U.S. Pat. No. 4,249,554 indicate emulsions which have an oil content of only 50%; this means that under these conditions half of the volume available (for example of a pipeline) cannot be used for transporting oil.

Canadian patents 1,108,205; 1,113,529; 1,117,568 and U.S. Pat. No. 4,246,919 on the other hand, reveal rather limited reductions in viscosity, even in the presence of a low oil content.

U.S. Pat. No. 4,770,199 describes the use of emulsifying agents consisting of complex mixtures of non-ionic alkoxylated surface-active agents and ethoxylated-propoxylated carboxylates. The non-ionic surface-active agent of this mixture is obviously sensitive to temperature and can consequently become insoluble in water under certain temperature conditions, inverting the phases, i.e. from O/W to W/O. Phase inversion can also be caused by high shear values during the moving operation.

Furthermore, the above surface-active agents are extremely expensive and considerably increase the cost of the process.

Finally, again in the field of O/W emulsions, EP-A-237,724 describes the use of mixtures of ethoxylated carboxylates and ethoxylated sulfates, products which are not easily available on the market.

Contrary to these documents, WO-94/01684 solves the problem of moving heavy crude oils by the formation of O/W dispersions obtained with the help of dispersing agents injected into the oil wells. With respect to the usual surface-active agents, the dispersing agents are sulfonates which are extremely soluble in water and which do not reduce the surface tension of the water to a great extent.

The problem, however, of the preparation of aqueous dispersions of heavy oil residues not only suitable for being transported but also for undergoing combustion with reduced emissions of sulfurated compounds, so-called $SO_x$, still remains unsolved. It is known in fact that during the combustion of oil fractions, most of the sulfur contained in the fuel reacts with oxygen forming sulfur dioxide and sulfuric anhydride, whereas only a small part is withheld by the ashes, depending on their alkalinity.

In accordance with this, the present invention relates to an aqueous dispersion of heavy oil residues, suitable for undergoing combustion with a low emission of $SO_x$, comprising:

(a) a heavy oil residue;

(b) a dispersing agent;

(c) a desulfurizing agent selected from $CaCO_3$, $MgCO_3$, dolomite and relative mixtures, the above desulfurizing agent being present in a quantity ranging from 0.5 to 3.0 moles, preferably from 1 to 2.5 moles, with respect to the sulfur contained in the heavy oil residue;

(d) a desulfurizing agent with stabilizing and anti-corrosive properties selected from MgO, $Mg(OH)_2$, CaO, $Ca(OH)_2$ and relative mixtures, the above desulfurizing agent being present in a quantity ranging from 0.04% by weight to 0.4% by weight with respect to the total suspension;

(e) water;

the weight percentage of (e) with respect to the sum of (a)+ (e) being at least 15%.

The weight ratio between water and heavy oil residue can vary within a wide range, for example from 85/15 to 15/85. It is preferable however, for economic reasons, to prepare dispersions with a high content of heavy oil residue, which are compatible with the fluidity requisites of the aqueous dispersion and its effective combustion. A good compromise between these various requisites is obtained with a water/heavy oil residue ratio ranging from 20/80 to 35/65.

As far as the dispersing agent (b) is concerned, as defined in EP-A-607,426, this relates to organic sulfonates of alkali metals or ammonium which, with reference to the sodium salt, have the following properties:

(A) a sulfur content of at least 10% by weight, preferably from 11 to 15% by weight;

(B) a solubility in water at 20° C. of at least 15% by weight, preferably from 20 to 60% by weight;

(C) a reduction in the surface tension in water, at a concentration of 1% by weight, lower than 10%.

The above properties unequivocally distinguish the dispersing agents of the present invention with respect to the usual sulfonated surface-active agents (for example alkyl benzene sulfonates). The latter in fact have completely different properties, for example a low solubility in water, a sulfur content normally lower than 10% and a considerable reduction in the surface tension in water. Typical examples of dispersing agents are products deriving from the condensation of (alkyl) naphthalenesulfonic acids and formaldehyde, sulfonated polystyrenes, lignin-sulfonates, the oxidative sulfonation products obtained by the treatment with $SO_3$ of particular aromatic fractions (for example the sulfonates described in EP-A-379,749 obtained by treating fuel oil from steam cracking with $SO_3$). Organic sulfonates which have dispersing properties are usually substances with a molecular weight greater than 1000. Owing to their high solubility in water and the presence of inorganic salts (for example sodium sulfate), it is extremely difficult to accurately determine their molecular weights.

The aqueous dispersion of the present invention contains a quantity of dispersing agent normally in relation to the quantity and type of heavy oil residue. In any case the quantity of dispersing agent necessary for having a stable and fluid dispersion ranges from 0.1 to 3% by weight, preferably from 0.3 to 1.5% by weight, said percentages referring to the quantity of dispersing agent with respect to the total quantity of water and heavy oil residue.

As far as the desulfurizing agents (c) are concerned, these are solids insoluble in water, capable of blocking or at least significantly reducing the $SO_x$ which is formed in the combustion phase. In the preferred embodiment, they have an average diameter lower than 300 μm, preferably from 1 to 50 μm. These dimensions allow a greater desulfurizing efficiency.

The desulfurizing agents with stabilizing and anticorrosive properties (d) also preferably have an average diameter of the same order of magnitude as that specified above for the desulfurizing agents (c).

If necessary, the dispersion of the present invention may also contain minimum quantities of hydrosoluble polymers, for example natural polysaccharides or natural derivatives, such as scleroglucanes, guar gum or xanthan gum. These hydrosoluble polymers can increase the stability to storage of the dispersion itself.

In addition to being fluid and stable, the aqueous dispersion of heavy oil residues of the present invention has the advantage of being able to undergo combustion according to the conventional techniques producing emissions with a low content of $SO_x$.

A further object of the present invention relates to a process for the preparation of a dispersion of heavy oil residues in water suitable for undergoing combustion with a low emission of $SO_x$, the above dispersion having a water content of at least 15% by weight, and being formed by putting the above heavy oil residue in contact with an aqueous solution of one or more dispersing agents selected from organic sulfonates of alkaline metals or of ammonium, which, with reference to the sodium salt, have the following properties:

(A) a sulfur content of at least 10% by weight, preferably from 11 to 15% by weight;

(B) a solubility in water at 20° C. of at least 15% by weight, preferably from 20 to 60% by weight;

(C) a reduction in the surface tension in water, at a concentration of 1% by weight, lower than 10%;

the above dispersion being prepared in the presence of (i) one or more desulfurizing agents selected from $CaCO_3$, $MgCO_3$, dolomite and relative mixtures, the above desulfurizing agents being present in a quantity ranging from 1.5 to 3.0 moles with respect to the sulfur contained in the heavy oil residue; and (ii) one or more desulfurizing agents with stabilizing and anticorrosive properties selected from MgO, $Mg(OH)_2$, CaO, $Ca(OH)_2$ and relative mixtures, the above desulfurizing agents with stabilizing and anticorrosive properties being present in a quantity ranging from 0.04% by weight to 0.4% by weight with respect to the total suspension.

Should the heavy oil residue have a softening point higher than about 25° C., it is preferable to heat the above heavy oil residue to a temperature which is at least equal to its softening point, in order to help its fluidification. Alternatively, the aqueous solution of the dispersing agent or both can be heated.

As far as compounds (i) and (ii) are concerned, these can be added, in the contact phase between the heavy oil residue and the aqueous solution of the dispersing agent, both as solids and as a dispersion of the solids themselves in water.

The mixing between the heavy oil residue and the aqueous solution of dispersing agents in the presence of solids (i) and (ii) can be effected using the usual mixing equipment, for example blade mixers, turbine mixers, etc. The mixing is continued until a sufficiently fluid dispersion is obtained, as to be pumpable and stable over a period of time.

The above preparation of the aqueous dispersion can be carried out "in situ", i.e. in the place where the heavy oil residue is formed (or produced). In this case, the dispersion will be transported, preferably via pipeline, to the combustion station. Alternatively, the preparation of the dispersion can be effected close to the combustion station. Intermediate solutions are obviously possible.

A further object of the present invention relates to a composition suitable for preparing aqueous dispersions of heavy oil residues which comprises:

(I) an aqueous solution of one or more dispersing agents selected from those described above;

(II) a desulfurizing agent selected from $CaCO_3$, $MgCO_3$, dolomite and relative mixtures;

(III) a desulfurizing agent with stabilizing and anti-corrosive properties selected from MgO, $Mg(OH)_2$, CaO, $Ca(OH)_2$ and relative mixtures.

The compounds (II) and (III) can be suspended in the aqueous solution (I) so as to have a single efficacious composition. Alternatively, compounds (II) and (III) can be stored apart as solids or aqueous suspension. In the latter case, compounds (II) and (III) are used together with the aqueous solution (I) during the preparation of the aqueous dispersion.

Alternatively, compounds (II) and (III) can be subsequently added to the aqueous dispersion prepared using the aqueous solution (I), preferably before feeding the aqueous dispersion to the combustion zone.

The following examples are provided for a better understanding of the present invention.

EXAMPLES

Examples 1-3 refer to the preparation of dispersions according to the present invention.

The following products are used:

(a) an oil residue having an API degree of 9, a viscosity at 25° C. of 120000 mPas and a sulfur content equal to 3.5% by weight;

(b) an aqueous mixture of the sodium salt of a naphthalene-sulfonic acid condensed with formaldehyde, in which calcium carbonate having an average particle size of 10 μm and magnesium oxide having an average particle size of 20 μm, are dispersed.

The dispersion is obtained by adding to the aqueous mixture heated to a temperature of about 80° C., the oil residue, also heated to the same temperature, and stirring the resulting mixture with a turbine stirrer at a rate of about 10000 rpm for a time varying from 20 to 120 seconds.

The dispersions thus obtained were brought to room temperature (about 25+ C.).

The viscosity of these dispersions was periodically controlled.

The viscosity measurements were effected with a Haake RV 12 rheometer at a shear rate of 10 $sec^{-1}$.

The results are indicated in Table 1.

| Ex. | Residue wt % | Water wt % | Disp. wt % | $CaCO_3$ wt % | MgO wt % | Viscosity (mPas) |
|---|---|---|---|---|---|---|
| 1 | 62.5 | 30.5 | 1.9 | 5.0 | 0.1 | 1296.5 |
| 2 | 60.9 | 29.9 | 1.8 | 7.2 | 0.2 | 1298.4 |
| 3 | 58.7 | 28.8 | 1.7 | 10.5 | 0.3 | 1644.2 |

The above dispersions 1-3 are also stable to storage for at least one week.

The invention claimed is:

1. A process for combustion of heavy oil residues with a low emission of $SO_x$ comprising:

heating the heavy oil residues at a temperature at least equal to a softening point of the heavy oil residues;

preparing a dispersion of the heated heavy oil residues in water, and combusting the dispersion of the heavy oil residues in water;

wherein the heavy oil residues have a softening point higher than 25° C., and wherein the dispersion of the heavy oil residues in water comprises:

one or more dispersing agents selected from organic sulfonates of alkali metals or of ammonium;

one or more desulfurizing agents selected from the group consisting of $CaCO_3$, $MgCO_3$, dolomite and relative mixtures; and one or more desulfurizing agents with stabilizing and anticorrosive properties selected from the group consisting of MgO, Mg $(OH)_2$, CaO, $Ca(OH)_2$ and relative mixtures; wherein the dispersion of heavy oil residue in water has a water content of at least 15%, the dispersing agent in the form of the sodium salt has the following properties:

(A) a sulfur content of at least 10% by weight;

(B) a solubility in water at 20° C. of at least 15% by weight;

(C) a reduction in the surface tension in water, at a concentration of 1% by weight, lower than 10%;

the desulfurizing agents are present in a quantity ranging from 0.5 to 3.0 moles with respect to the sulfur contained in the heavy oil residue, and the desulfurizing agents with stabilizing and anticorrosive properties are present in a quantity ranging from 0.04% by weight to 0.4% by weight with respect to the total suspension.

2. The process according to claim 1, wherein the desulfurizing agent selected from $CaCO_3$, $MgCO_3$, dolomite and relative mixtures, is present in a quantity ranging from 1 to 2.5 moles with respect to the sulfur contained in the heavy oil residue.

3. The process according to claim 1, wherein a weight ratio of water/heavy oil residue ranges from 20/80 to 35/65.

4. The process according to claim 1, wherein the desulfurizing agents have an average diameter lower than 300 μm.

5. The process according to claim 1, wherein the dispersing agent is present in a quantity ranging from 0.1 to 3% by weight, said percentages referring to the quantity of dispersing agent with respect to the total quantity of water and heavy oil residue.

* * * * *